US005921756A

United States Patent [19]

Matsuda et al.

[11] Patent Number: 5,921,756

[45] **Date of Patent: *Jul. 13, 1999**

[54] SWASH PLATE COMPRESSOR INCLUDING DOUBLE-HEADED PISTONS HAVING PISTON SECTIONS WITH DIFFERENT CROSS-SECTIONAL AREAS

[75] Inventors: Mikio Matsuda; Kazuhide Uchida; Mitsuo Inagaki, all of Nishio; Takeshi Sakai, Chiryu, all of Japan

[73] Assignees: Denso Corporation, Kariya; Nippon Soken, Inc., Nishio, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/760,159

[22] Filed: Dec. 3, 1996

[30] Foreign Application Priority Data

Dec. 4, 1995 [JP] Japan ..... 7-315621
Dec. 5, 1995 [JP] Japan ..... 7-316917

[51] Int. Cl.[6] ..... F04B 1/26

[52] U.S. Cl. ..... 417/269; 92/71; 91/499

[58] Field of Search ..... 417/269; 92/71; 91/502, 499

[56] References Cited

U.S. PATENT DOCUMENTS 5,009,574 4/1991 Ikeda et al. ..... 417/269
5,252,032 10/1993 Iwanami et al. ..... 417/269
5,765,996 6/1998 Fuji et al. ..... 417/269

FOREIGN PATENT DOCUMENTS 1-227877 9/1989 Japan .
90/07683 7/1990 WIPO .

*Primary Examiner*—Charles G. Freay
*Assistant Examiner*—Cheryl J. Tyler
*Attorney, Agent, or Firm*—Pillsbury Madison & Sutro LLP

[57] ABSTRACT

A swash plate type compressor having pistons, each defining on opposite sides compression chambers 38 and 39. The cross sectional area of the operating chamber 39 located adjacent the driving source is larger than the cross sectional area of the operating chamber 38 located away from the driving source in such a manner that the axial force F0 generated in a rotating shaft 5 due to the difference between the pressure at the swash plate chamber and the atmospheric pressure is substantially canceled by the axial forces F1 and F2 generated in the rotating shaft due to the refrigerant pressure acting on the piston 8 in the operating chambers 38 and 39.

5 Claims, 10 Drawing Sheets

SWASH PLATE COMPRESSOR INCLUDING DOUBLE-HEADED PISTONS HAVING PISTON SECTIONS WITH DIFFERENT CROSS-SECTIONAL AREAS

BACKGROUND OF THE INVENTION

1. Field of the Invention

The present invention relates to a swash plate compressor of an open type which is operated by an outside drive force source. The present invention can be suitably used for a refrigerating system using a LO refrigerant at a high operating pressure, such as carbon dioxide ($CO_2$).

2. Description of the Related Art

A swash plate type compressor is known having a swash plate arranged obliquely with reference to an axis of a rotating shaft. A rotating movement of the swash plate cause pistons to be axially reciprocated. A volume of an operating chamber on one side of the piston is increased during an intake stroke of the piston and decreased during an exhaust stroke of the piston. Thus, during the intake stroke, the refrigerant is sucked into the operation chamber, while, during the exhaust stroke, the refrigerant is discharged from the operating chamber.

An axial thrust force is generated in the swash plate, which is transmitted to the rotating shaft. Thus, thrust bearings for receiving the thrust force are arranged between faced axial surfaces of a boss portion of the swash plate and a housing.

As the refrigerant, a freon has been conventionally used. However the use of freon has been restricted. Thus, the inventors have recently studied carbon dioxide ($CO_2$) as a refrigerant for executing a refrigerating cycle. During such a study, the inventors have found that the use of carbon dioxide as a refrigerant causes the service life of the thrust bearing to be highly reduced when compared with a service life of the thrust bearing when the freon is used as a refrigerant.

In view of this, tests regarding the service life of thrust bearings have been conducted by the inventors. From these test, it has been found that an axial force is generated in the rotating shaft of the compressor for a kinematic connection to the outside rotating source due to a difference between an atmospheric pressure and a pressure inside a chamber for storing the swash plate, which corresponds to a pressure to the refrigerant sucked into the compressor. This pressure difference between the outside pressure and the inside pressure is highly increased in the refrigerating system using carbon dioxide as the refrigerant due to an increased intake pressure, which is as high as 35 kgf/cm$^2$ over the conventional system using the freon. As a result, a load as generated in the thrust bearing is also greatly increased, which causes the service life of the thrust bearing to be highly shortened. According to a calculation by the inventors, the conventional refrigerating system using freon (of intake pressure of 2 kgf/cm$^2$) generates a thrust force of about 10 kgf, while the refrigerating system using the carbon dioxide generates a thrust force of 200 kgf. This means that a highly increased thrust force is generated in the thrust bearings in the refrigerating system using the carbon dioxide compared to the refrigerating system using freon.

SUMMARY OF THE INVENTION

An object of the present invention is to provide a swash plate compressor capable of overcoming the above mentioned difficulties.

Another object of the present invention is to provide a swash plate compressor capable of reducing the load generated in thrust bearings.

Further another object of the present invention is to provide a swash plate compressor capable of preventing a service life from being reduced.

In accordance with the invention, an arrangement is employed in which an axial force in the rotating shaft due to a difference between a pressure at the swash plate chamber and an atmospheric pressure outside the housing is canceled or substantially canceled by the forces generated in the piston by means of pressure at the first and second operating chambers. In accordance with a further feature of the invention a transverse cross sectional area of the piston section forming one of the first and the second operating chambers which is located adjacent the outside rotating movement source is larger than that of the other piston located spaced from said outside rotating movement source.

These arrangements make it possible for the axial thrust force in the thrust bearings to be reduced, thereby increasing a service life of the thrust bearings and increasing a reliability of the operation. Furthermore, such a reduction of the axial force can prevent the size of the thrust bearing from being increased, thereby preventing the size of the compressor from being increased.

In accordance with an embodiment of the invention, a first stage compression to an intermediate pressure is done at the first operating chamber, and a second stage compression to the outlet pressure is done at the second operating chamber. Furthermore, again an arrangement is employed such that an axial force in the rotating shaft due to a difference between a pressure at the swash plate chamber and an atmospheric pressure outside the housing is substantially canceled by the forces generated in the piston by means of pressure at the first and second operating chambers.

Thus, an advantage similar to that described above, is also obtained.

BRIEF EXPLANATION OF ATTACHED DRAWINGS

DESCRIPTION OF PREFERRED EMBODIMENTS

Now, embodiments of the present invention will be explained with reference to attached drawings.

First Embodiment

Figure 1:
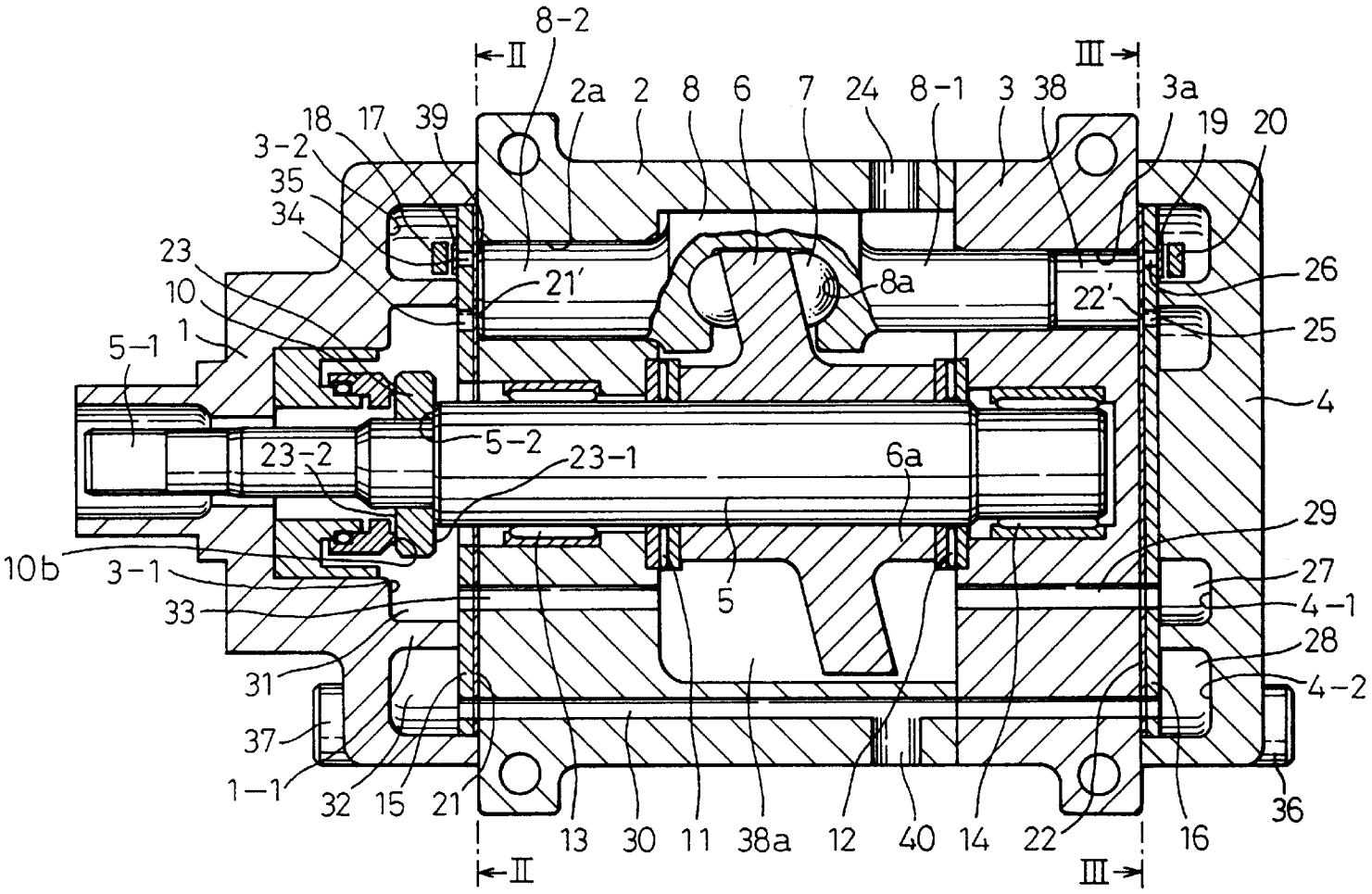
FIG. 1 is a longitudinal cross sectional view of a swash plate type compressor according to a first embodiment of the present invention.

In FIG. 1, a reference numeral 1 denotes a front housing, 2 a front cylinder block, 3 a rear cylinder block, and 4 a rear housing. A rotating shaft 5 is rotatably connected to the cylinder blocks 2 and 3 by means of radial bearings 13 and 14, respectively. The rotating shaft 5 has an end 5-1 connected to a clutch (not shown) for selective connection of the rotating shaft 5 with a rotating source, such as a crankshaft of an internal combustion engine (not shown), so that a rotating movement from the crankshaft is transmitted to the rotating shaft 5 under an engaged condition of the clutch.

The front cylinder block 2 is formed with three equiangularly spaced and axially extending cylinder bores 2*a*, while the rear cylinder block 3 is formed with three equiangularly spaced and axially extending cylinder bores 3*a*, which are under an axial aligned arrangement with respect to corresponding cylinder bores 2*a* of the front cylinder block 2. Three double headed pistons 8 extend axially and are arranged also equiangularly spaced. Each of the pistons 8 has a rear piston portion 8-1, which is axially slidably inserted to the corresponding cylinder bore 3*a* of the rear cylinder block 3 and a front piston portion 8-2, which is axially slidably inserted to the corresponding cylinder bore 2*a* of the front cylinder block 2. On one side of the rear piston portion 8-1 in the corresponding cylinder bore 3*a*, a rear operating chamber 38 is formed. Similarly, on one side of the front piston portion 8-2 in the corresponding cylinder bore 2*a*, a front operating chamber 39 is formed.

Figure 4:
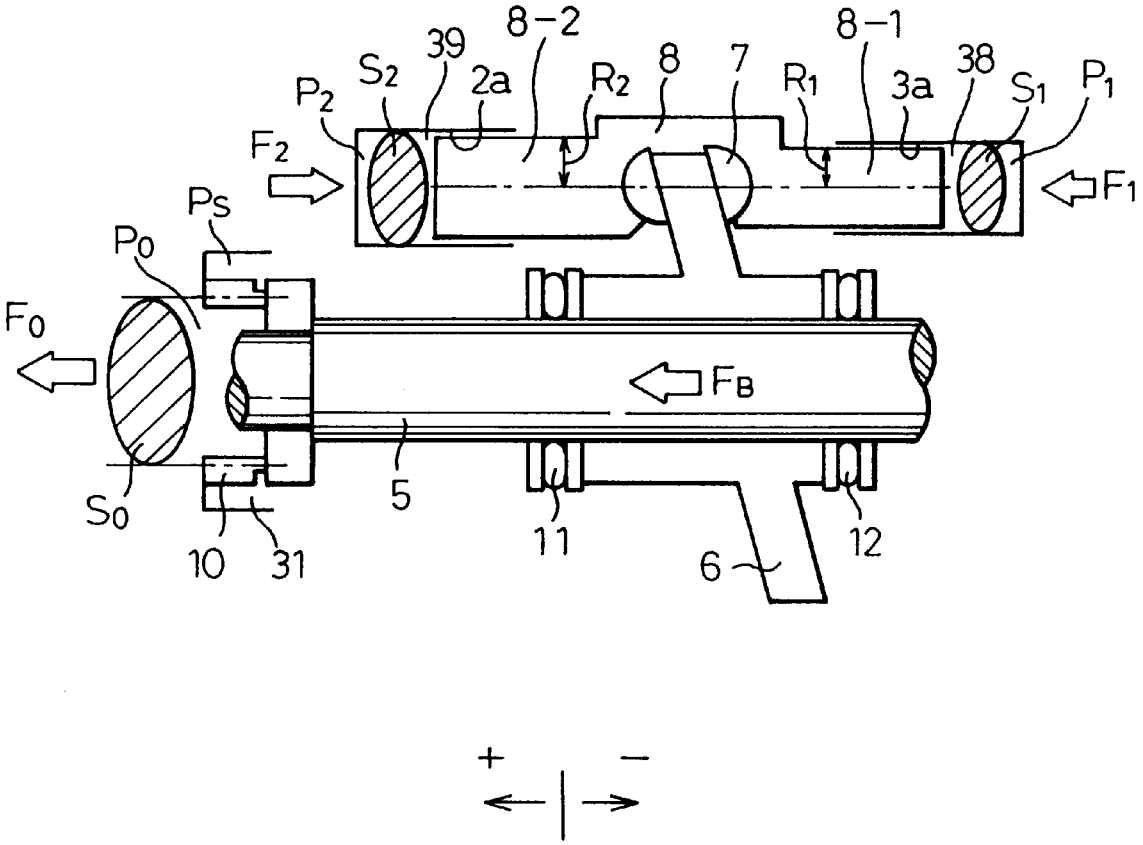
FIG. 4 is a schematic view illustrating thrust forces applied to a rotating shaft of the compressor in FIG. 1.

As shown in FIG. 4, a transverse cross sectional area $S_2$ of the front operating chamber 39 is larger than a transverse cross sectional area $S_1$ of the rear operating chamber 38. In other words, an outer radius of the front piston portion 8-2, i.e., an inner radius of the cylinder bore 2*a* is larger than an outer radius of the rear piston portion 8-1, i.e., an inner radius of the cylinder bore 3*a*.

In FIG. 1, a reference numeral 6 denotes a swash plate, which has a tubular boss portion 6*a*, which is fitted to the rotating shaft 5 and fixed thereto by means of a suitable fixing means. The swash plate 6 has a plane, which is inclined with respect to the axis of the shaft 5 at a predetermined angle. Furthermore, the swash plate 6 is axially engaged with the pistons 8 by way of shoes 7 which are inserted to substantially semi-spherical faced grooves 8*a* formed in the piston 8. As a result, a rotating movement of the swash plate 6 caused by the rotating movement of the rotating shaft 5 causes the pistons 8 to be axially reciprocated. As a result, the piston portions 8-1 and 8-2 axially slide in the corresponding cylinder bores 3*a* and 2*a*, thereby decreasing the volume of the operating chamber 38 or 39 during an axial movement in one direction and increasing the volume of the operating chamber 38 or 39 during an axial movement in the opposite direction. In this operation of the swash plate 6, the shoes 7 allow the swash plate 6 and the pistons 8 to be move smoothly with each other.

The rotating movement of the swash plate 6 causes a thrust force to be generated thereon, which causes the swash plate 6 to be axially urged toward the housing. In view of this, a front thrust bearing 11 is arranged between faced end surfaces of the front cylinder block 2 and the boss portion 6*a* of the swash plate 6, while a rear thrust bearing 12 is arranged between faced end surfaces of the rear cylinder block 3 and the boss portion 6*a* of the swash plate 6.

The cylinder block 2 is formed with an inlet 24, which is in connection with an evaporator (not shown), so that an evaporated refrigerant from the evaporator is received by the inlet 24. The inlet 24 is opened to a swash plate chamber 38*a* formed between the cylinder blocks 2 and 3, in which chamber the swash plate 6 rotates.

The front housing 1 is formed with a circular projection 1-1 by which a central circular recess 3-1 and an outer annular recess 3-2 are formed, so that these recess are opened to the cylinder block 2, while a valve seat plate 15 is arranged between the front housing 1 and the cylinder block 2. As a result, an intake chamber 31 is formed by the recess 3-1, which is in communication with the swash plate chamber 38*a* via an intake passageway 33 formed in the cylinder block 2 and the valve plate 15. On one side of the valve seat plate 15 adjacent the cylinder block 2, a valve plate 21 is arranged. The valve plate 21 is formed with three equiangularly spaced intake valve portions 21', which are, in a well known manner, formed by slitting the valve plate 21 along a desired profile located around corresponding intake ports 34 formed in the valve seat plate 15. As a result, the pressure of the operating chamber 39 is lower than the pressure at the intake chamber 31 causing the intake valve portions 21' to be displaced against its resiliency, thereby allowing the corresponding intake ports 34 to be opened. Furthermore, an exhaust chamber 32 is formed inward of the recess 3-2, in which exhaust valve assemblies are arranged, each of which is constructed by a valve member 17 (a reed valve), a valve stopper plate 18 and a fixing means (not shown) for fixedly connecting the members 17 and 18 onto the valve seat plate 15. In a well known manner, the valve member 17 rests, due to its resiliency, on the valve seat plate 15, so as to close a corresponding valve port 35 formed in the valve seat plate 15 and opened to a corresponding operating (compression) chamber 39. Thus, a pressure at the operating chamber 39 higher than a predetermined value causes the valve member 17 to be displaced against its resilient force, thereby obtaining a communication between the operating chamber 39 and the exhaust chamber 32.

Similarly, the rear housing 4 is formed with an inner annular recess 4-1 and an outer annular recess 4-2, which are adjacent the cylinder block 3, while a valve seat plate 16 is arranged between the rear housing 4 and the cylinder block 3. As a result, an intake chamber 27 is formed by the recess 4-1, which is in communication with the swash plate chamber 38*a* via an intake passageway 29 formed in the cylinder block 3 and the valve plate 16. On the side of the valve seat plate 16 adjacent the cylinder block 3, a valve plate 22 is arranged. The valve plate 22 is formed with three equiangularly spaced intake valve portions 22', which are formed by slitting the valve plate 22 along a desired profile located around corresponding intake ports 25 formed in the valve seat plate 16. As a result, a pressure of the operating chamber 38 lower than the pressure at the intake chamber 27 causes the intake valve portions 22' to be displaced against the resiliency, thereby allowing the corresponding intake ports 25 to be opened. Furthermore, an exhaust chamber 28 is formed inward of the recess 4-2, in which exhaust valve assemblies are arranged, each of which is constructed by a valve member 19 (a reed valve), a valve stopper plate 20 and a fixing means (not shown) for fixedly connecting the members 19 and 20 onto the valve seat plate 16. In a well known manner, the valve member 19 rests, due to its resiliency, on the valve seat plate 16, so as to close a corresponding valve port 25 formed in the valve seat plate 16 and opened to a corresponding operating (compression) chamber 38. Thus, a pressure at the operating chamber 38 higher than a predetermined value causes the valve member 19 to be displaced against its resilient force, thereby obtaining a communication between the operating chamber 38 and the exhaust chamber 28.

The front valve seat plate 15 as well as the intake valve plate 21 are sandwiched between the front housing 1 and the front cylinder block 2 and are connected integrally therewith by means of a plurality of equiangularly spaced bolts 37. In a similar way, the rear valve seat plate 16 as well as the intake valve plate 22 are sandwiched between the rear housing 4 and the rear cylinder block 3 and are connected integrally therewith by means of a plurality of equiangularly spaced bolts 36.

A shaft seal 10 is arranged inside the front housing 1 for preventing a lubricant from being leaked via a clearance between the front housing 1 and the rotating shaft 5. A ring member 23 is inserted to the rotating shaft 5, so that the ring member 23 is, at its one end surface 23-1, engaged with a shoulder portion 5-2 of the shaft 5. Furthermore, the axial seal member 10 is arranged to one side of the ring member 23 adjacent to the housing 1, so that the axial seal member 10 is, at its end surface 10*b*, axially contacted with the other end surface 23-2 of the ring member 23.

The cylinder block 2 is formed with an outlet port 40, which is connected to a passageway 30 formed in the cylinder blocks 2 and 3. The passageway 30 has ends opened to the outlet chambers 28 and 32, so that the compressed refrigerant from the outlet chambers 28 and 32 is discharged from the outlet port 40.

In a well known manner, the compressor 1 forms, together with a condenser (not shown), an expansion valve (not shown) and an evaporator (not shown), a refrigerating system. During the operation of the compressor, the refrigerant to be sucked via the intake port 24 is under a low pressure, which is about 35 kgf/cm$^2$ in this embodiment and is referred to as an intake pressure Ps below. The sucked refrigerant is first introduced into the swash plate chamber 38*a* and is then, via the connection passageways 33 and 29, introduced into the intake chambers 31 and 27. The refrigerant in the intake chambers 31 and 27 is introduced into the operating chambers 39 and 38 via the intake valves 21' and 22' opened during the intake stroke of the piston portion 8-2 and 8-1. The refrigerant in the operating chambers 39 and 38 is subjected to a compression to a pressure, which is about 110 kgf/cm$^2$ and, in this embodiment, is referred to as a discharge pressure Pd. The refrigerant of high pressure in the operating chambers 39 and 38 is discharged into the outlet chambers 32 and 28 via the outlet valves 17 and 19 opened during an exhaust stroke of the piston portions 8-2 and 8-1. The compressed refrigerant is discharged, from the outlet port 40, to the condenser, whereat the refrigerant is subjected to condensation. The condensed refrigerant is subjected to a pressure reduction at the expansion valve. The refrigerant at a reduced pressure is introduced into the evaporator and is returned to the compressor for repetition of the above cycle.

FIG. 4 schematically illustrates an arrangement of the swash plate 6 on the rotating shaft 5 with respect to the piston 8 and is for illustrating an axial load generated in the thrust bearings 11 and 12. As explained above, an axial force F0 acts on the rotating shaft 5 due to a difference between the intake pressure Ps of the refrigerant (the pressure at the swash plate chamber 38*a*) and the atmospheric air pressure P0. Furthermore, axial forces F1 and F2 due to the pressure of the refrigerant in the operating chambers 39 and 38 are generated in the piston 8, which also act on the rotating shaft 5 via the swash plate 6.

Namely, the total axial force FB acted to the thrust bearings 11 and 12 is a sum of the axial force F0 due to the pressure difference and the compression reaction forces F1 and F2, and is expressed by the following equation.

$$FB=F0+F1+(-F2) \quad (1)$$

In the above equation, the positive direction of the force corresponds to the direction of the axial force F0.

The force F0 due to the pressure difference is expressed by F0=S0×(Ps−P0), where S0 is the pressure receiving surface whereat the atmospheric air pressure acts to the rotating shaft. Namely, in the rotating shaft 5, the atmospheric pressure P0 generates an axial force in the negative direction, while the intake pressure Ps generates an axial force in the positive direction. Thus, a force, which corresponds to the difference Ps−P0, is generated in the positive direction.

The force F1 due to the pressure P1 in the operating chamber 38 is expressed by F1=P1×S1, while the force F2 due to the pressure P2 in the operating chamber 39 is expressed by F2=P2×S2.

As will be clear from the above equation, the direction of the force F2 acting on the front piston portion 8-2 in the front operating chambers 39 is opposite to the direction of the axial force F0 due to the pressure difference and the force F1 acting on the rear piston portion 8-2 in the rear operating chambers 38. As a result, these forces in the opposite directions can be reduced or nearly canceled if the ratio of the radii of the piston portions 8-1 and 8-2 is suitably selected. Thus, an axial force FB generated in the thrust bearings 11 and 12 can be reduced, thereby preventing a service life of the bearings 11 and 12 from being reduced, resulting in an improvement of a reliability in an operation of the compressor.

Furthermore, the present invention makes it possible to reduce the axial force FB acting on the thrust bearings 11 and 12, thereby preventing their size from being increased, i.e., preventing the size of the compressor from being increased.

Figure 5:
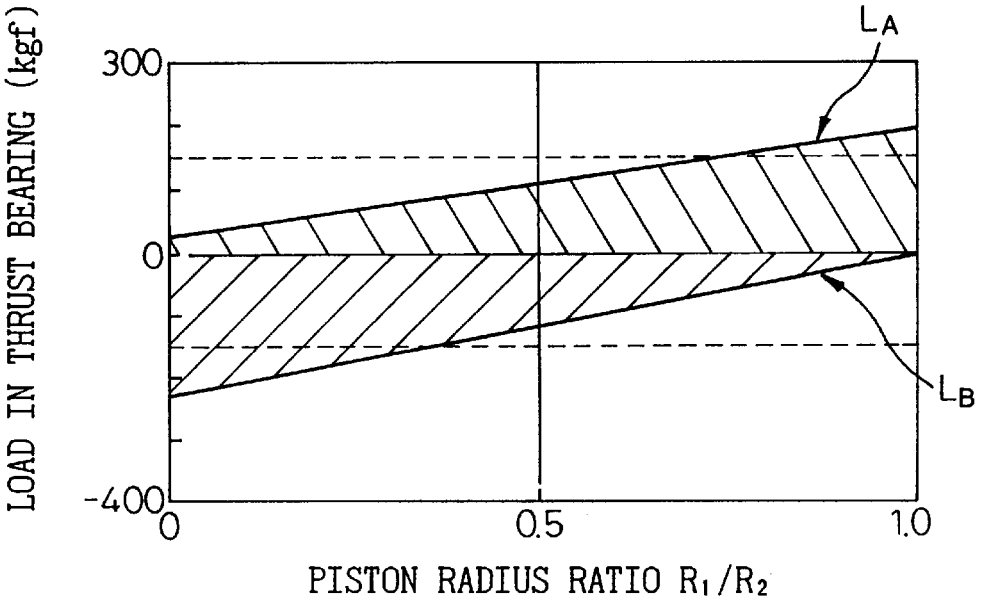
FIG. 5 is a graph illustrating relationships between a piston radius ratio and a thrust force in a rotating shaft.
Figure 6:
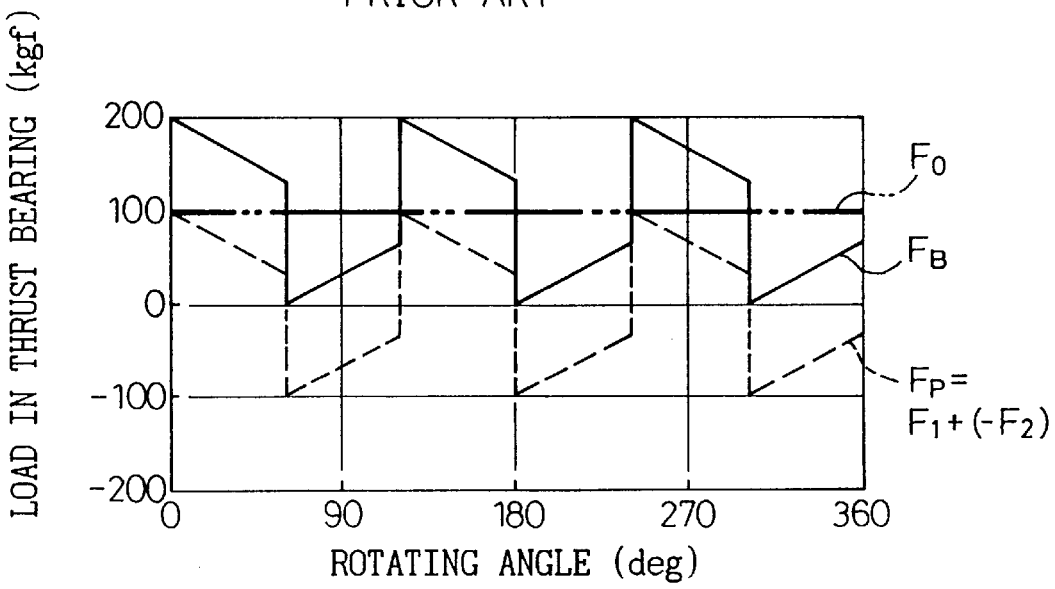
Fig.6 PRIOR ART
FIG. 6 is a graph illustrating relationships between a rotating angle of a shaft and axial forces in a compressor in a prior art.

In FIG. 5, the abscissa shows a ratio of a radius R1 of the rear piston section 8-1 to a radius R2 of the front piston section 8-2, which is referred as a piston radius ratio, while the ordinate shows an axial thrust force FB calculated by the above mentioned equation (1). In FIG. 5, a value of 1.0 of the radius ratio R1/R2 corresponds to a prior art, where the radius of the front piston portion 8-2 is equal to the radius of the rear piston portion 8-1. FIG. 6 shows, for this prior art construction of R2=R1, a result of the calculation illustrating how values of F0, F1+(−F2) and FB vary during a complete rotation of the rotating shaft under particular dimensions of the compressor that S1=S2=7.9 cm$^2$ (R2=R1=0.5 cm) and S0=2.9 cm$^2$. Namely, during the rotation of the rotating shaft 5, the value of the axial force R0 due to the pressure difference between the swash plate chamber and the atmospheric air pressure is maintained at 100 kgf. Contrary to this, the value of the total force due to the pressure in the operating chambers, that is F1+(−F2), is periodically changed between 100 kgf and −100 kgf. As a result, the final axial force, which is sum of F0, which is equal to 100 kgf, and F1+(−F2), which is periodically changed between 100 kgf and −100 kgf, is periodically varied between 0 and 200 kgf, as shown by solid line in FIG. 6. Namely, in FIG. 5, the point of the radius ratio R1/R2=1.0 on the abscissa corresponds to this prior art, where the thrust force as generated is varied in a R1/R2 range between 0 and 200 kgf. In other words, the maximum absolute value of the thrust force is 200 kgf. A reduction of the radius ratio R1/R2 causes the maximum value of the thrust force to be changed in a positive value side along a line $L_A$ and causes the minimum value of the thrust force to be changed in a negative value side along a line $L_B$. In other words, the difference of about 200 kgf between the maximum value and the minimum value is unchanged irrespective of the reduction of the value of the radius ratio R1/R2. However, the reduction of the radius ratio R1/R2 causes the absolute value of the thrust force to be reduced. Namely, the best result is obtained at a range of the values of the radius ratio R1/R2 which is located around 0.5. Namely, at this range, the absolute maximum value of the thrust force can be reduced to a value of about 100 kgf, which is about half of that, i.e., 200 kgf, obtained when the radius ratio R1/R2 is equal to 1.0 in the prior art.

It should be noted that, in FIGS. 5 and 6, the positive direction of the axial force FB corresponds to the direction of the axial force generated due to the pressure difference between the pressure at the swash plate chamber and the atmospheric pressure. Namely, the region of values of the thrust load FB designated by the hatched lines inclined downwardly at the right hand side shows the thrust force in the positive direction which acts on the thrust bearing 11, while the region of values of the thrust load FB designated by the hatched lines inclined upwardly at the right hand side shows the thrust force in the negative direction, which acts on the thrust bearing 12.

It should be noted that the setting of the value of the radius ratio R1/R2 is such that the thrust force acting on the thrust bearing 11 and the thrust force acting on the thrust bearing 12 are substantially equalized. In this case, the required bearing function is obtained in both directions by the thrust bearings 11 and 12 of the same structure or size. In other words, an increased bearing performance is not required to any one of the thrust bearings, thereby preventing the compressor from being increased in size.

In the above embodiment, an arrangement can also be arranged wherein an outlet pressure at the front operating chamber 39 is higher than that at the rear operating chamber 38, and the discharged flows from these chambers are combined before discharged from the outlet port 40.

Second Embodiment

Figure 7:
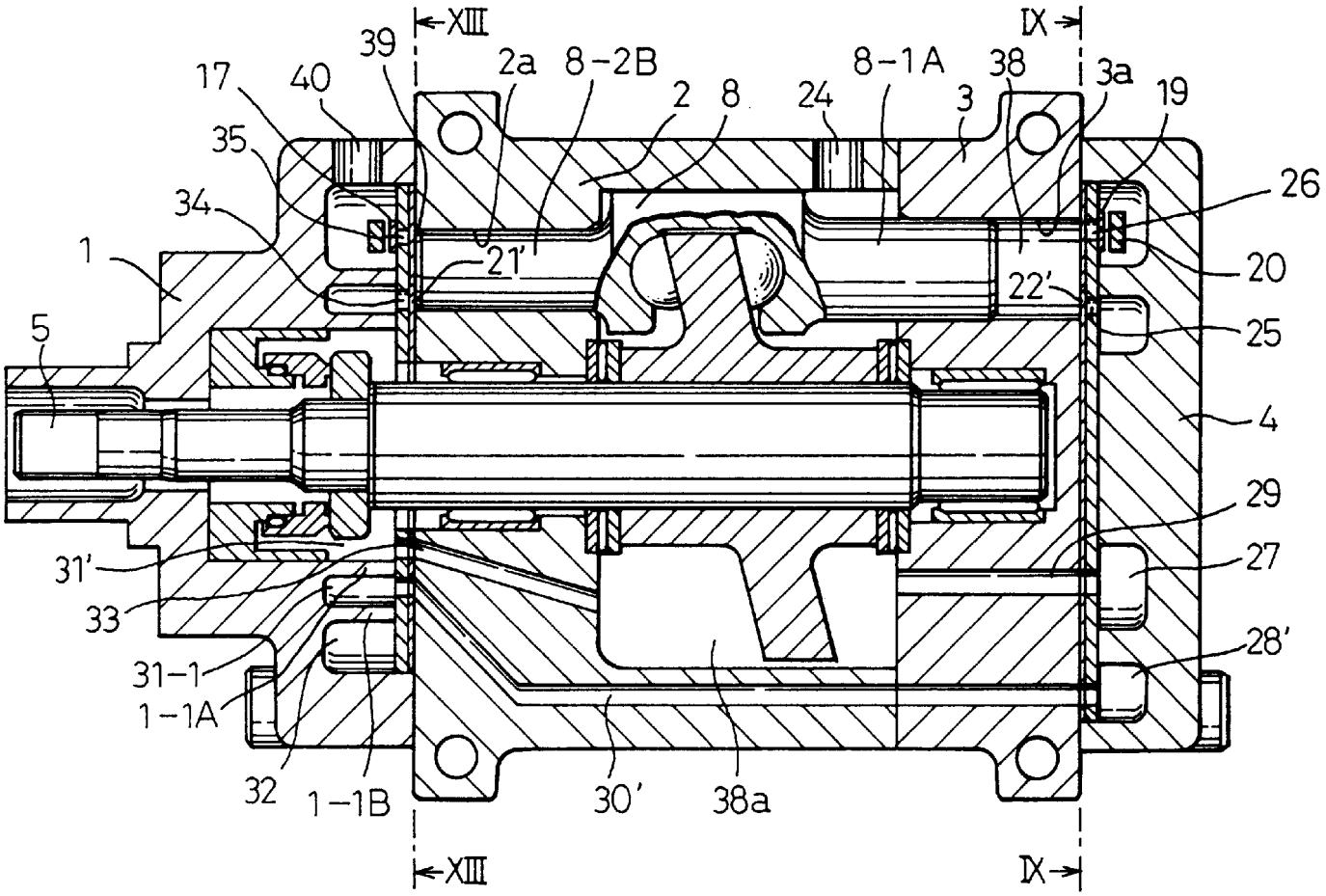
FIG. 7 is a longitudinal cross sectional view of a swash plate type compressor of a two stage compression type, according to the second embodiment of the present invention.
Figure 8:
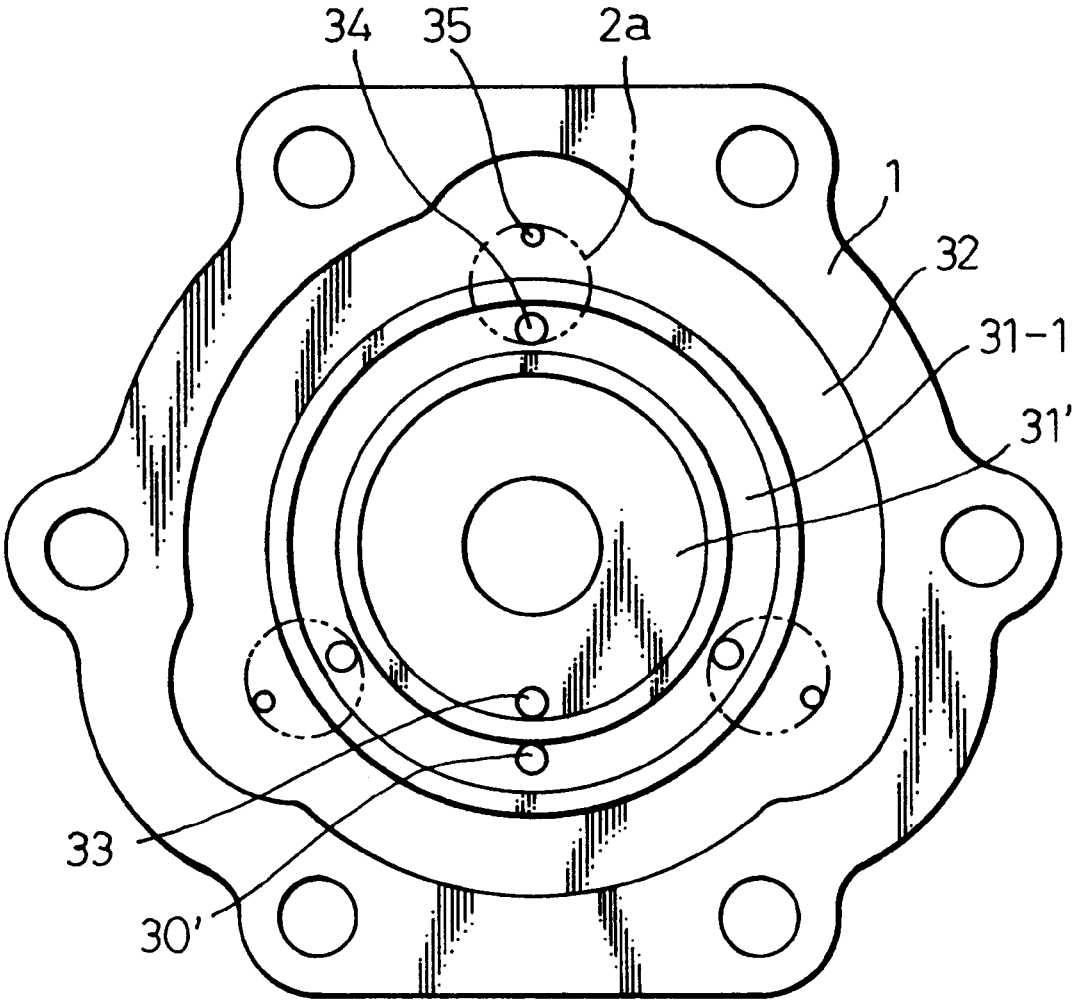
FIG. 8 is a view taken along a line XIII—XIII in FIG. 7.
Figure 9:
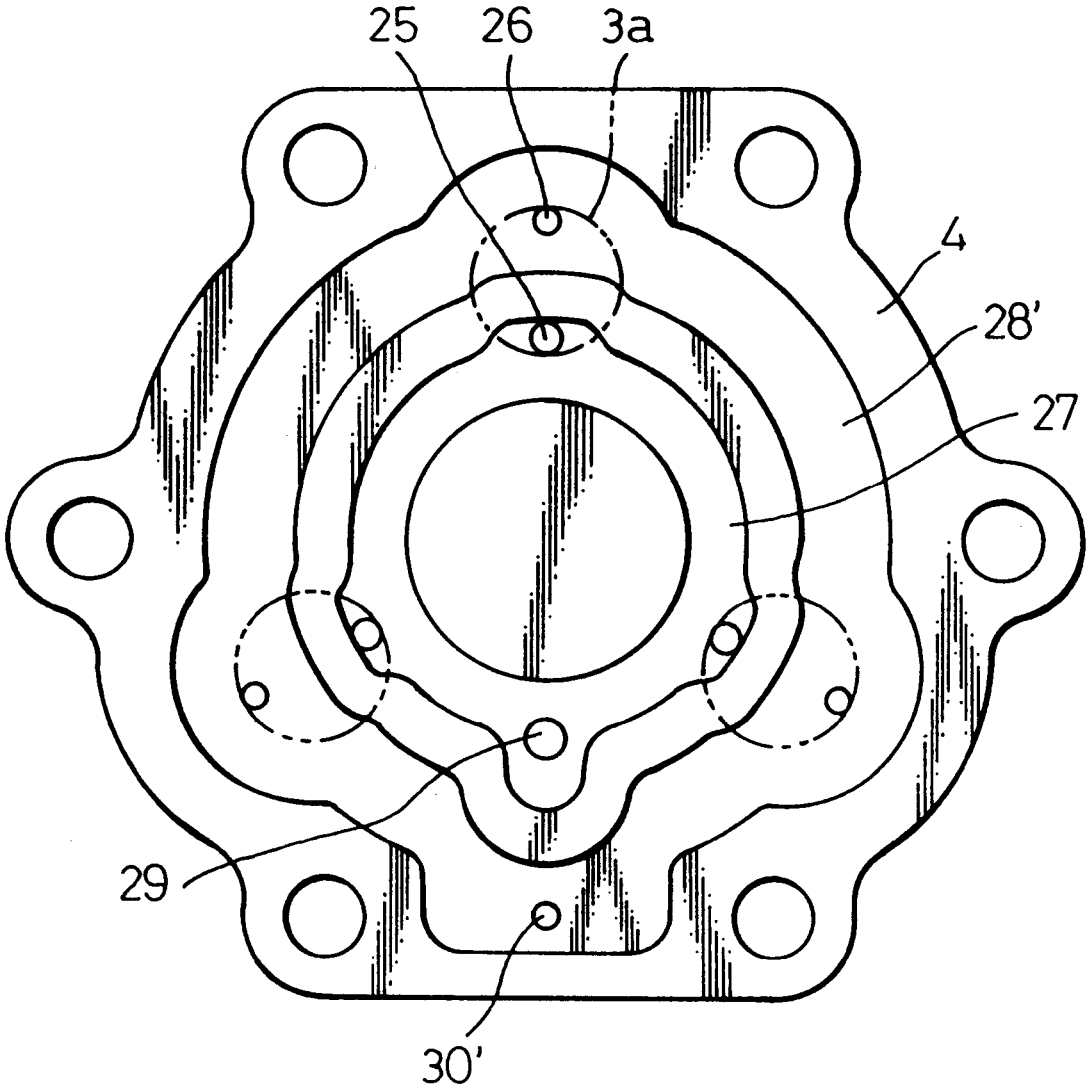
FIG. 9 is a view taken along a line IX—IX in FIG. 7.
Figure 10:
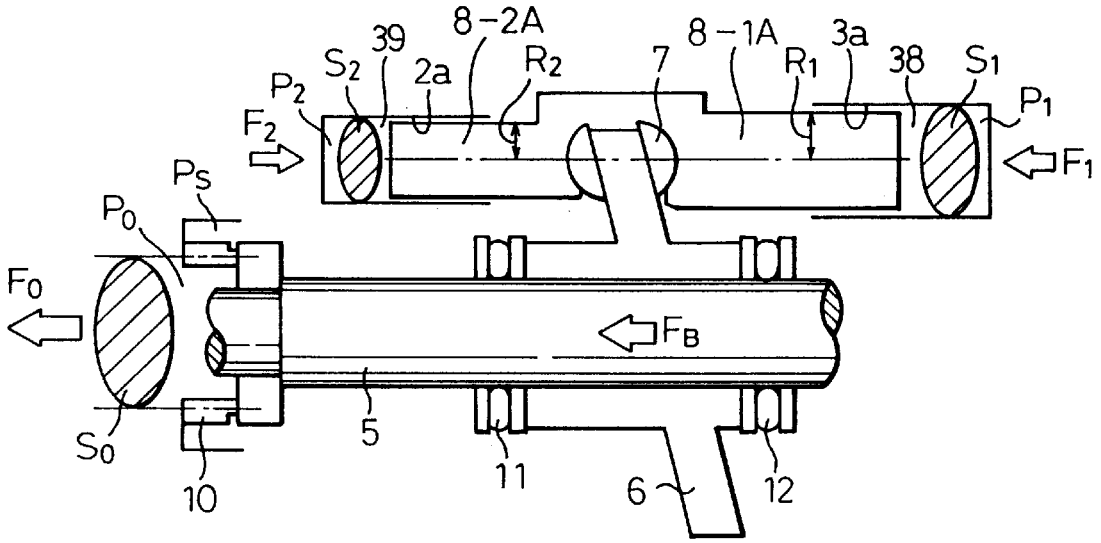
FIG. 10 is a schematic view illustrating thrust forces applied to a rotating shaft of the compressor in FIG. 7.

FIG. 7 shows a second embodiment of the compressor according to the present invention, wherein two stage compression is done. Namely, the front housing 1 is formed with an inner and outer projections 1-1A and 1-1B, so that a shaft seal chamber 31' is formed inside the inner projection 1-1A, while an intermediate pressure chamber 31-1 is formed between the inner and the outer projections 1-1A and 1-1B. Outside the outer projection 1-1B, an exhaust chamber 32 is formed. The front housing 1 is formed with an outlet opening 40 which is opened to the exhaust chamber 32, which is communication with the condenser (not shown) for constructing the refrigerating system. The shaft seal chamber 31' is, via the passageway 33, connected to the swash plate chamber 38*a*, which is in communication with the inlet opening 24 and is in communication with the intake chamber 27 between the rear cylinder block 3 and the rear housing 4. Between the rear cylinder block 3 and the rear housing 4, an intermediate pressure chamber 28' is formed, which is in communication with the intermediate pressure chamber 31-1 via a passageway 30' formed in the cylinder blocks 2 and 3.

Figure 2:
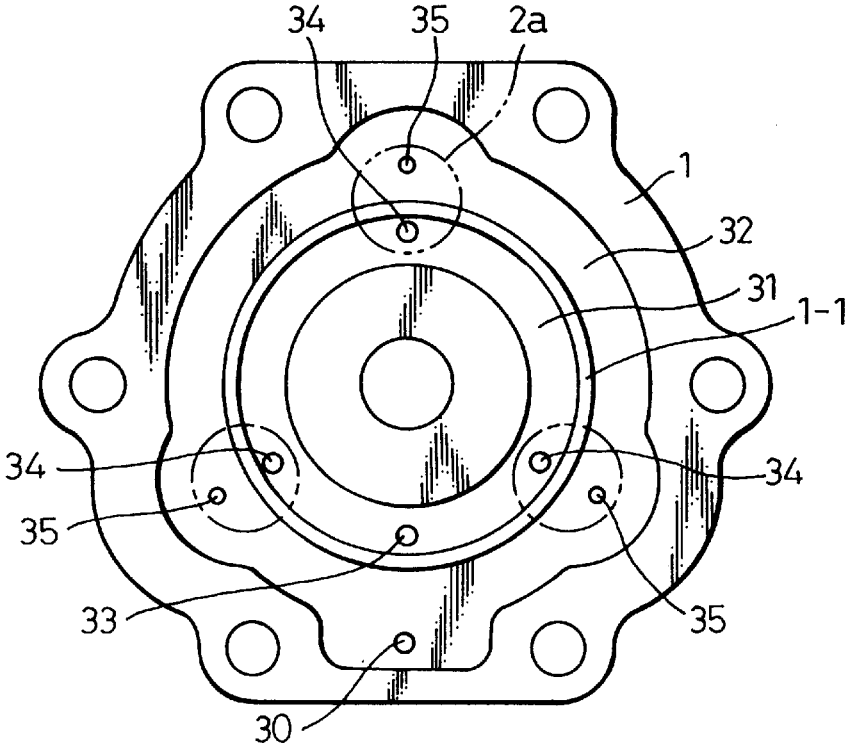
FIG. 2 is a view taken along a line II—II in FIG. 1.
Figure 3:
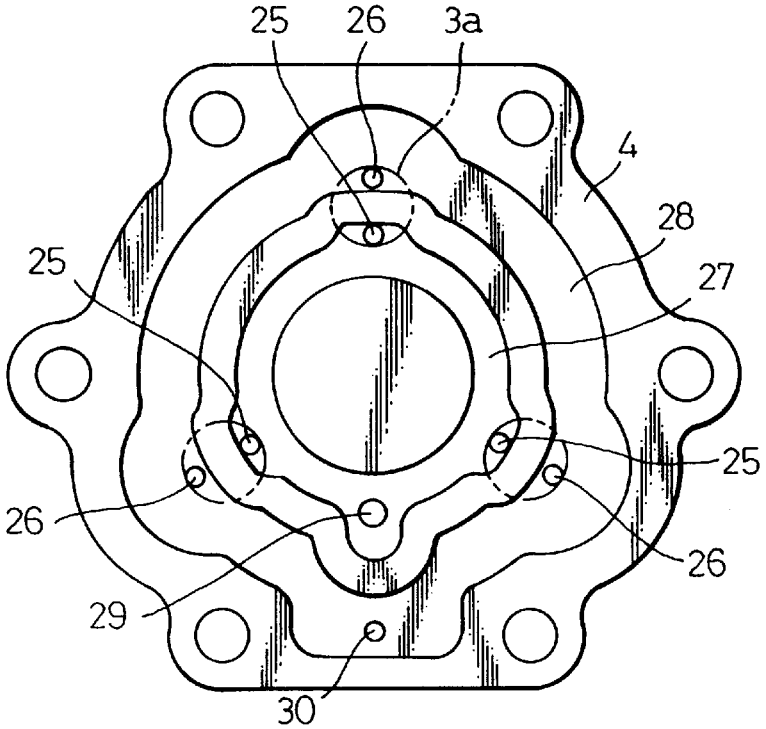
FIG. 3 is a view taken along a line III—III in FIG. 1.

As shown in FIG. 7, the piston is constructed by a rear piston portion 8-1A of an increased diameter and a front piston portion 8-2A of a decreased diameter. The rear piston portion 8-1A forms the rear operating chamber 38 which is in communication with the intake chamber 27 via the intake valve 22' and the intake port 25 and is in communication with the intermediate pressure chamber 28' via the discharge port 26 and the outlet valve 19. The front piston portion 8-2A forms the front operating chamber 39 which is in communication with the intake chamber 31-1 via intake valve 21' and the intake port 34 and is in communication with the exhaust chamber 32 via the discharge port 35 and the outlet valve 17. The remaining construction is the same as that of the first embodiment in FIGS. 1 to 3, and therefore a detailed explanation thereof will be eliminated.

Now, a compression operation of the compressor of the second embodiment will be explained. The refrigerant of an intake pressure Ps as low as about 35 kgf/cm$^2$ sucked from the intake opening 24 is introduced into the swash plate chamber 38*a* and is introduced into the intake chamber 27. The refrigerant in the intake chamber 27 is sucked into the rear operating chamber (first state compression chamber) 38 via the intake port 25 and the admission valve 22' opened during the intake stroke of the piston portion 8-1A. During the compression stroke of the piston portion 8-1A, the refrigerant in the chamber 38 is subjected, in the first state compression to a pressure of, for example, 60 kgf/cm$^2$ and is discharged into the intermediate pressure chamber 28' via the outlet port 26 and the discharge valve 19. The refrigerant in the chamber 28' is, via the passageway 30', introduced into the opposite intermediate pressure chamber 31-1. During the intake stroke of the front piston portion 8-2A, the refrigerant in the chamber 31-1 is sucked into the front operating chamber (second stage compression chamber) 39 via the intake port 34 and the admission valve 21'. During the compression stroke of the front piston portion 8-2A, the refrigerant in the chamber 39 is compressed to an outlet pressure Pd of, for example, 110 kgf/cm$^2$ and is discharged to the outlet chamber 32 via the outlet port 35 and the discharge valve 17.

Figure 11:
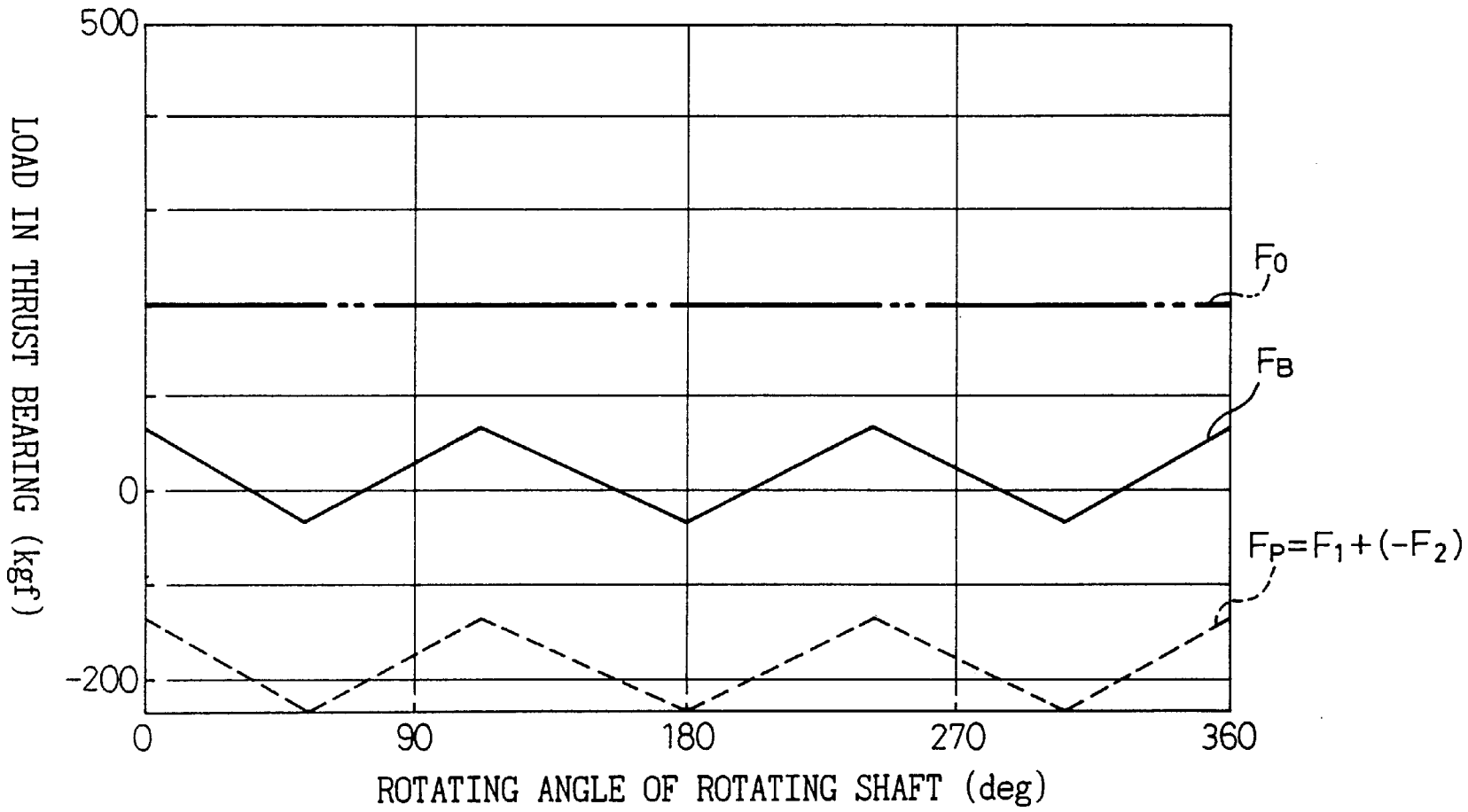
FIG. 11 is a graph illustrating relationships between a rotating angle of a shaft and axial forces in the compressor in the second embodiment of the present invention.
Figure 12:
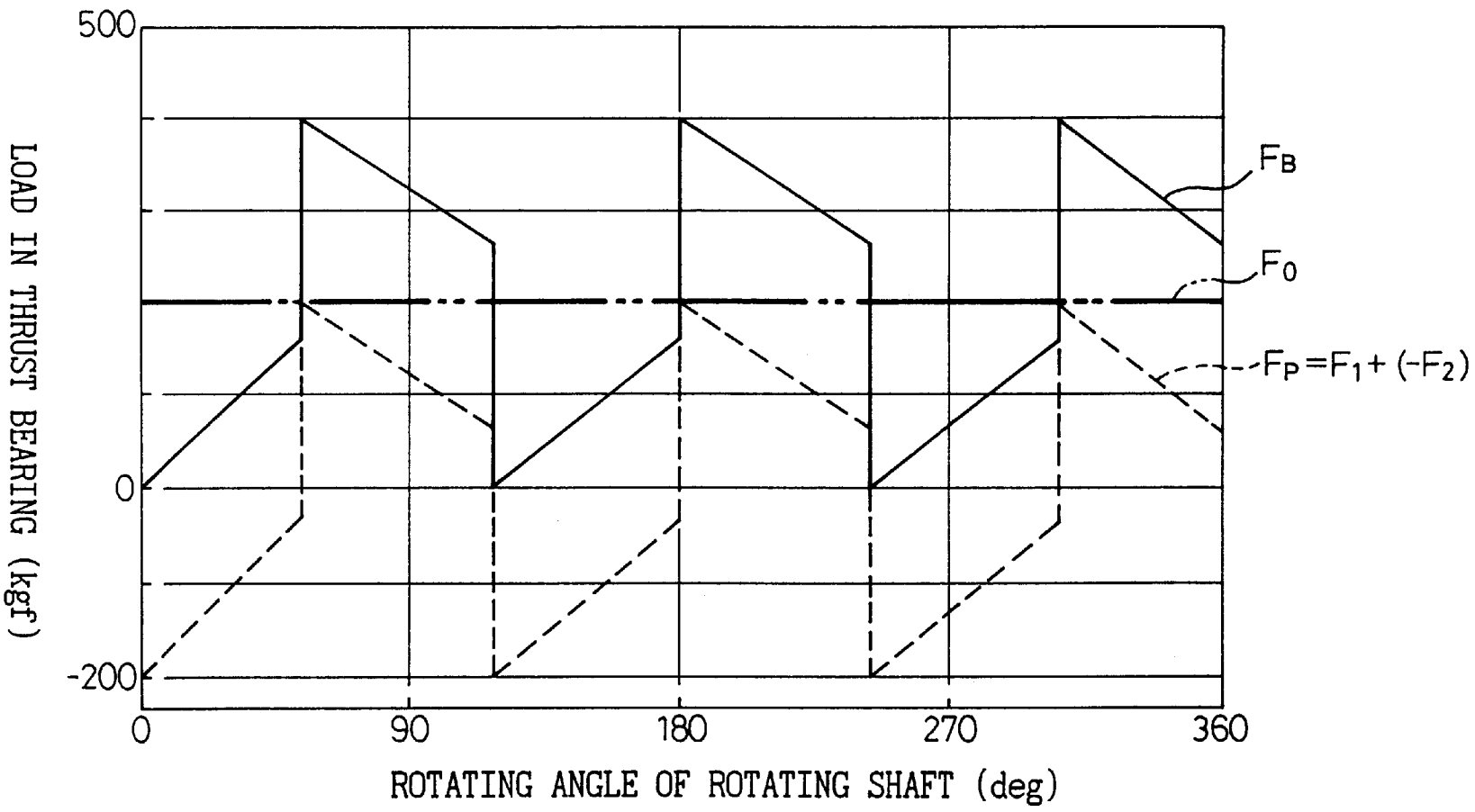
Fig.12 PRIOR ART
FIG. 12 is a graph illustrating relationships between a rotating angle of a shaft and axial forces in the compressor in the prior art.

In the similar way as to the first embodiment, an axial force FB is generated in the rotating shaft 5, which is expressed by $$FB=F0+F1+(-F2),$$

where F0 is an axial force F0 due to the difference between the intake pressure Ps at the swash plate chamber 38*a* and the atmospheric air pressure P0 and F1 and F2 are axial forces corresponding the compression reaction force in the operating chambers 38 and 39. As in the first embodiment, a suitable selection of the radius ratio R1/R2 of the piston portions 8-1A and 8-2A can generate a value of F1+(−F2) which substantially cancels the axial force F0, thereby reducing the total axial force FB. In this embodiment, compressor is of a two stage compression type, i.e., the pressure at the rear (first stage) operating chamber 38 is lower than the pressure at the front (second stage) operating chamber 39. Thus, in order to obtain the axial force canceling operation, the relationship of the radius of the piston portions 8-1A and 8-2A is reversed over that the first embodiment. In other words, the radius R1 of the rear piston portion 8-1A is larger than that R2 of the front piston portion 8-2B. Namely, FIG. 11 shows the calculated axial force F0 due to the pressure difference, the sum of the axial forces due to the compression reaction forces F1+(−F2) and the final axial force FB during the one complete rotation of the shaft 5 when S0 (cross sectional area of pressure receiving surface of the rotating shaft 5)=5.7 cm$^2$, S1 (cross sectional area of the first stage compression piston 8-1A)=3.1 cm$^2$, and S2 (cross sectional area of the second stage compression piston 8-2A)=2.0 cm$^2$. As will be seen from FIG. 11, the maximum absolute value of the thrust force FB of this embodiment of the compressor is about 80 kgf. FIG. 12 shows F0, F1+(−F2) and FB in the construction of prior art single stage compressor of the same dimensions as that of the embodiment in FIG. 7. As will be easily seen from FIG. 12, during the 360 degree of rotation of the rotating shaft 5, the axial thrust force FB (=F0+F1+(−F2)) is varied between 0 kgf to kgf. Thus, this embodiment of the present invention can reduce the axial thrust force to ⅕ of the force produced in the construction of the prior art.

In the two stage compression according to the second embodiment of the present invention, the refrigerant is subjected to a first stage compression to an intermediate pressure at the operating chamber 38, which is followed by a second stage compression to the outlet pressure at the operating chamber 39. Thus, in comparison with the single stage compression from the inlet pressure to the outlet pressure, a prolonged duration for the compression from the inlet pressure to the outlet pressure is obtained over the construction of the prior art. As a result, a reduction of the leaked amount of the refrigerant by way of the gaps between the piston portion 8-1A and 8-2A and the cylinder bores 2*a* and 2*b* is obtained, thereby enhancing the compression efficiency even if a refrigerant for a high operating pressure, such as carbon dioxide, is employed.

Modifications

The present invention is not be limited to the above embodiments and various modification can be made. First, in the above embodiments, the compressor is provided with three pistons 8. However, a different number of the piston 8 can be used.

In the above first and second embodiments, the compression ratio is identical between the front and rear chambers 38 and 39, while the piston radius ratio R1/R2 is varied between the piston portions 8-1 (8-1A) and 8-2 (8-2A) in such a manner that the compression reaction forces F1 and F2 are canceled with respect to the axial force F0 caused by the pressure difference between the operating chambers 38 and 39. However, the cancellation of the axial force can be made by differentiating the compression ratio between the operating chambers 38 and 39.

Furthermore, in the above embodiments, the passageway for communicating the rear chamber 28 or 28' with the front chamber 32 is formed in the cylinder blocks 2 and 3. However, a separate pipe can be used for effecting the similar function.

Furthermore, the piston 8 is not limited to the having a circular cross sectional shape. Namely, a piston of a different cross sectional shape, such as an elliptic shape can be used.

Finally, the compressor according to the present invent is not limited to use in a refrigerating system using the carbon dioxide as a refrigerant. Namely, the present invention can be used for a refrigerating system using any type of refrigerant for an increased operating pressure.

We claim:

1. A swash plate type compressor comprising:

a housing;

a rotating shaft supported rotatably by the housing;

thrust bearings in the housing for receiving an axial thrust force generated in the rotating shaft;

said housing being formed with cylinder bores extending axially;

a double headed piston having axially spaced apart piston sections arranged for an axial reciprocating movement of the piston sections provided in each of the respective cylinder bores;

a swash plate chamber formed in the housing;

a swash plate arranged in the swash plate chamber and fixedly connected to the rotating shaft in such a manner that the swash plate is engaged with the piston so as transform the rotating movement of the rotating shaft into an axial reciprocating movement of the piston sections;

first and second operating chambers formed in each of the cylinder bores by respective piston sections, wherein the first and second operating chambers are of differing sizes and are axially opposite one another;

an inlet port formed in the housing for receiving a fluid to be subjected to compression, said inlet port being in communication with the swash plate chamber;

an outlet port formed in the housing discharging the compressed fluid after being subjected to compression;

first and second introducing means for independent introduction of the fluid at the inlet port into the first and second operating chambers, respectively, so that the fluid is subjected to compression in the first and second operating chambers, respectively; and first and second discharging means for independent discharge of the compressed fluid at the first and second operating chambers, respectively, to the outlet port;

wherein: the rotating shaft is exposed to an atmospheric pressure outside the housing and the rotating shaft is acted on by a total axial force having an average value and composed of a first axial force which is produced by the atmospheric pressure, a second axial force produced by a pressure of fluid in the swash plate chamber, a third axial force produced by pressures in the first operating chambers and a fourth axial force produced by pressures in the second operating chambers; the first and fourth axial forces act on the rotating shaft to urge the rotating shaft in a first axial direction and the second and third axial forces act on the rotating shaft to urge the rotating shaft in a second axial direction opposite to the first axial direction; each piston section forming a first operating chamber has, in a direction transverse to the piston axis, a first cross-sectional area and each piston section forming a second operating chamber has, in the direction transverse to the piston axis, a second cross-sectional area; and the second cross-sectional area is larger than the first cross-sectional area by an amount that substantially cancels the average value of the total axial force.

2. A swash plate type compressor according to claim 1 wherein the second cross-sectional area is two times the first cross-sectional area.

3. A swash plate type compressor comprising:

a housing;

a rotating shaft supported rotatably by the housing;

thrust bearings in the housing for receiving an axial thrust force generated in the rotating shaft;

said housing being formed with cylinder bores extending axially;

a double headed piston having axially spaced apart piston sections arranged for an axial reciprocating movement of the piston sections provided in each of the respective cylinder bores;

a swash plate chamber formed in the housing;

a swash plate arranged in the swash plate chamber and fixedly connected to the rotating shaft in such a manner that the swash plate is engaged with the piston so as transform the rotating movement of the rotating shaft into an axial reciprocating movement of the piston sections;

first and second operating chambers formed in each of the cylinder bores by respective piston sections, wherein the first and second operating chambers are of differing sizes and are axially opposite one another;

an inlet port formed in the housing for receiving a fluid to be subjected to compression, said inlet port being in communication with the swash plate chamber;

an outlet port formed in the housing discharging the compressed fluid after being subjected to compression;

first and second introducing means for independent introduction of the fluid at the inlet port into the first and second operating chambers, respectively, so that the fluid is subjected to compression in the first and second operating chambers, respectively; and first and second discharging means for independent discharge of the compressed fluid at the first and second operating chambers, respectively, to the outlet port;

said first operating chambers being located remote from one axial end of the rotating shaft, while said second operating chambers are located adjacent said one axial end of the rotating shaft;

the first operating chambers being for compression of the medium at the intake port to an intermediate pressure;

the second operating chambers being for compression of the medium at the first operating chamber so that the pressure of the medium discharge to the outlet port is increased to an outlet pressure;

wherein: the rotating shaft is exposed to an atmospheric pressure outside the housing and the rotating shaft is acted on by a total axial force having an average value and composed of a first axial force which is produced by the atmospheric pressure, a second axial force produced by a pressure of fluid in the swash plate chamber, a third axial force produced by pressures in the first operating chambers and a fourth axial pressure produced by pressures in the second operating chambers; the first and fourth axial forces act on the rotating shaft to urge the rotating shaft in a first axial direction which extends from the second operating chambers to the first operating chambers and the second and third axial forces act on the rotating shaft to urge the rotating shaft in a second axial direction opposite to the first axial direction, each piston section forming a first operating chamber has, in a direction transverse to the piston axis, a first cross-sectional area and each piston section forming a second operating chamber has, in the direction transverse to the piston axis, a second cross-sectional area, and the first cross-sectional area is larger than the second cross-sectional area by an amount that substantially cancels the average value of the total axial force.

4. A swash plate type compressor according to claim 3 wherein the first cross-sectional area is two times the second cross-sectional area.

5. A swash plate type compressor according to claim 3, wherein the housing is formed with a communication passageway for introducing the fluid compressed at the first operating chambers into the second operating chambers.

* * * * *